United States Patent [19]

Teague et al.

[11] 4,161,928

[45] Jul. 24, 1979

[54] THROTTLE BODY ASSEMBLY

[75] Inventors: Kenneth W. Teague, Dayton, Ohio; Kenneth A. Graham, Beverly Hills, Mich.

[73] Assignee: Chrysler Corporation, Highland Park, Mich.

[21] Appl. No.: 925,572

[22] Filed: Jul. 17, 1978

Related U.S. Application Data

[63] Continuation of Ser. No. 719,021, Aug. 30, 1976.

[51] Int. Cl.[2] ..... F02D 11/10

[52] U.S. Cl. ..... 123/102; 123/97 R

[58] Field of Search ..... 123/102, 97 R, 103 C, 123/103 E

[56] References Cited

U.S. PATENT DOCUMENTS

| | | | |
|---|---|---|---|
| 3,556,064 | 1/1971 | Date et al. | 123/102 X |
| 3,603,298 | 9/1971 | Toda et al. | 123/102 X |
| 3,721,223 | 3/1973 | Randan et al. | 123/102 |
| 3,809,034 | 5/1974 | Durichen | 123/102 |

*Primary Examiner*—Ira S. Lazarus

*Attorney, Agent, or Firm*—Baldwin & Newtson

[57] ABSTRACT

A throttle body assembly comprises a throttle body having an induction passage therein with a pair of rotatively coupled, parallel shafts extending across the induction passage. A pair of blades are affixed to each shaft with each blade comprising a main blade section for selectively restricting the induction passage in accordance with shaft rotation and an auxiliary blade section which presents a curved confronting surface to an adjacent wall portion of the induction passage so as to preclude intrusion of any appreciable amount of induction air between each blade and the corresponding wall portion over the operative rotational range of the shafts. A fuel spray bar is disposed centrally in the induction passage upstream of the throttle blades for spraying fuel into the induction air stream. A pressure regulator assembly is disposed on the fuel spray bar and contains main and auxiliary pressure relief valve assemblies via which fuel from a control pump is delivered to the spray bar. A constant engine idle speed control comprises an electric motor which is controllably rotatable in opposite directions, when the throttle control linkage is in the idle position, to adjust the position of the throttle blades so that a substantially constant engine idle speed is maintained which is independent of engine load and temperature. The motor is operatively coupled with the throttle shafts via novel linkage for securing at-idle adjustment of the blades.

3 Claims, 26 Drawing Figures

THROTTLE BODY ASSEMBLY

This is a continuation of application Ser. No. 719,021, filed Aug. 30, 1976.

BACKGROUND AND SUMMARY OF THE INVENTION

This invention relates broadly to throttle body assemblies and is particularly concerned with a throttle body assembly having a novel control mechanism useful in providing constant engine idle speed control.

In a vehicle having an internal combustion engine, it is desirable to create as homogeneous a combustible mixture as possible in order to obtain more complete combustion in the cylinders of the engine. The steps toward attainment of the homogeneous mixture begin in a throttle body where fuel is introduced into the induction passage through which air is drawn. The present application discloses a throttle body assembly containing novel throttle blade and air-fuel mixture structure which is beneficial in promoting more homogeneous fuel/air mixture and modulation of said mixture in accordance with engine demand. In the disclosed embodiment, induction air is confined to a central region of the induction passage where the fuel distribution system sprays liquid fuel into the induction airstream. The throttle body assembly is particularly adapted for use in an electronic fuel metering system, generally of the type shown in U.S. Pat. No. 3,935,851 assigned to the same assignee as the present application.

The claimed invention in this application relates to a novel control mechanism useful for engine idle speed control for adjusting the throttle blades, when the engine is in idle, to maintain a substantially constant engine idle speed which is independent of engine load and temperature. Such a constant idle speed control accomplishes better engine performance and avoids fuel waste thereby improving fuel economy.

The foregoing features, advantages, and benefits, along with additional ones, will be seen in the ensuring description and claims which are to be considered in conjunction with the accompanying drawings which disclose an illustrative, but preferred, embodiment of the present invention according to the best mode presently contemplated in carrying out the invention.

REFERENCE TO RELATED APPLICATIONS

Reference is made to the application of Kenneth A. Graham, entitled "Throttle Body Having A Novel Throttle Blade", now matured into U.S. Pat. No. 4,066,721 and to the application of Kenneth W. Teague, entitled "Fuel Spray Bar And Pressure Regulator System," now matured into U.S. Pat. No. 4,132,204.

BRIEF DESCRIPTION OF THE DRAWINGS

FIG. 8 is an enlarged fragmentary sectional view taken along line 8—8 in FIG. 7;

DESCRIPTION OF THE PREFERRED EMBODIMENT

Introduction

Figure 1:
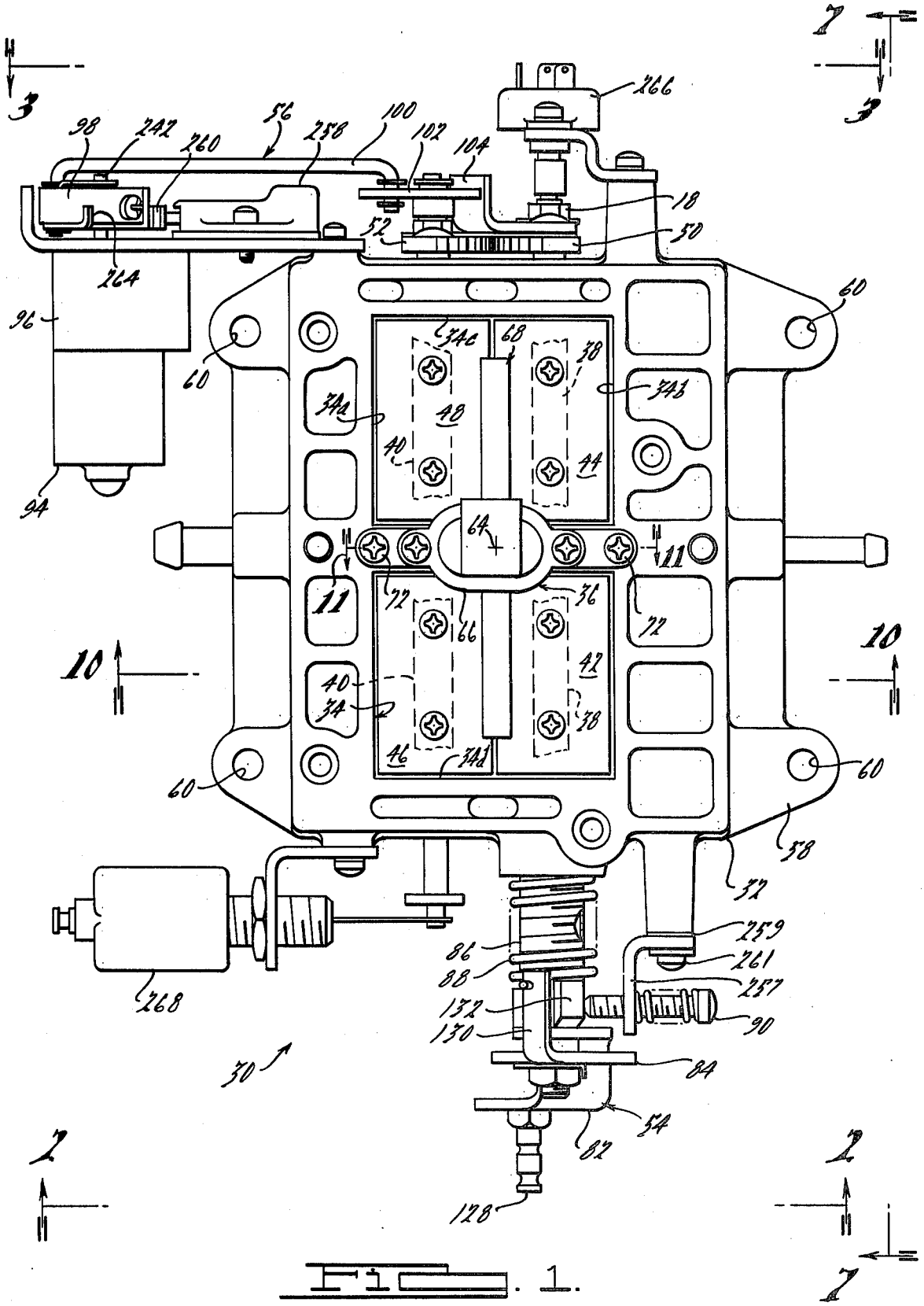
FIG. 1 is a plan view of a throttle body assembly embodying principles of the present invention.
Figures 2, 3:
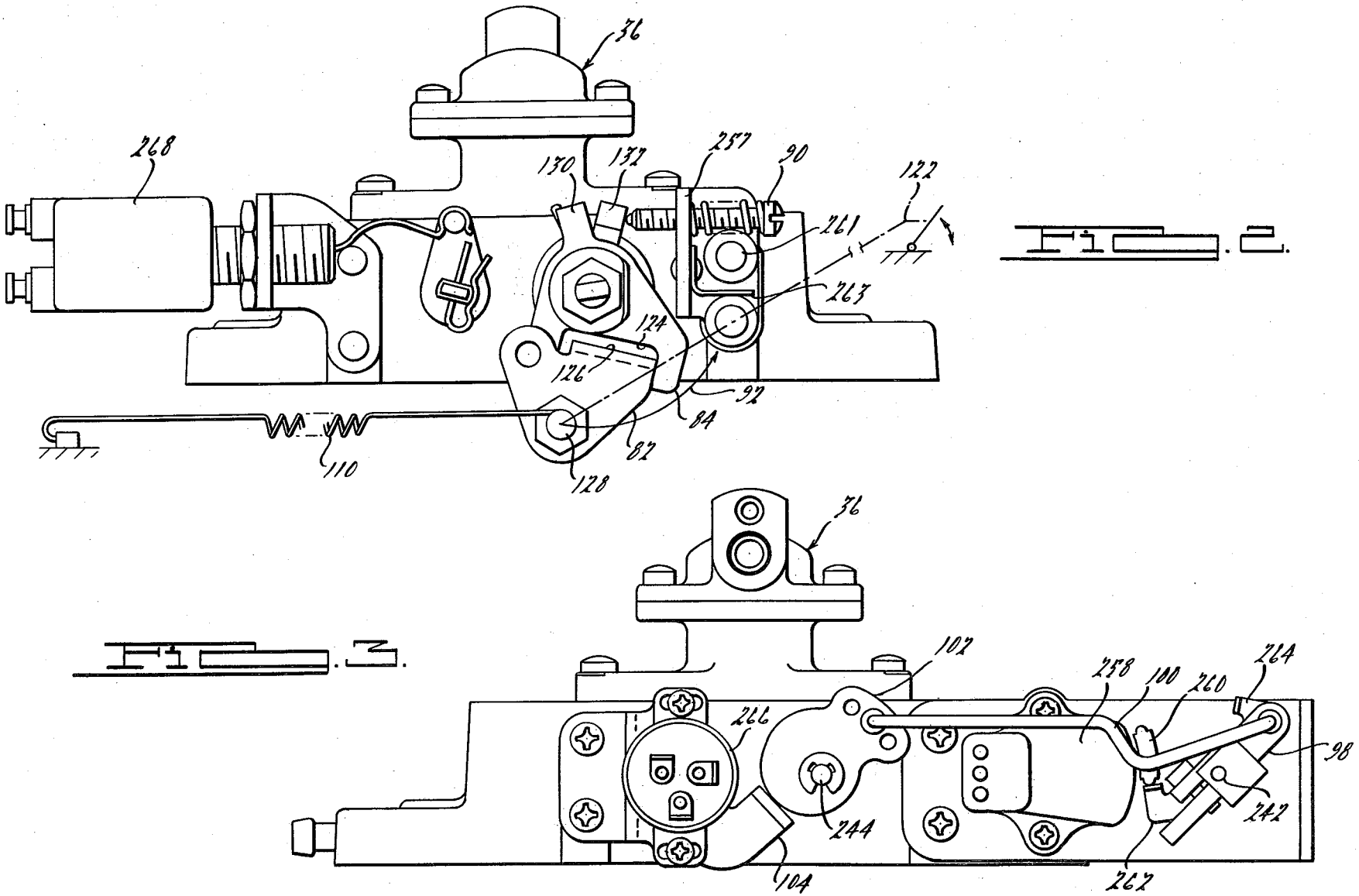
FIG. 2 is a view taken along line 2—2 in FIG. 1.
FIG. 3 is a view taken along line 3—3 in FIG. 1.

FIGS. 1 through 3 illustrate a preferred embodiment of throttle body assembly 30 embodying principles of the present invention. Assembly 30 comprises a throttle body 32 having an air induction passage 34; a fuel distribution system 36; a pair of throttle shafts 38, 40; four individual throttle blades 42, 44, 46, 48; a pair of meshed sector gears 50, 52; an operator-controlled throttle actuating mechanism 54; and a constant engine idle speed control mechanism 56.

Throttle body 32 has a base 58 adapted to be positioned on an engine intake manifold (not shown) to register induction passage 34 with the inlet port of the intake manifold. Attachment may be effected by means of bolts (not shown) passing through holes 60 at the four corners of base 58 with a suitable gasket (not shown) disposed between throttle body 32 and the intake manifold. In the preferred embodiment disclosed herein, induction passage 34 has a rectangular cross-sectional shape as shown in FIG. 1. Passage 34 is divided into two halves, or ports, by means of a vertical partition 62 (FIG. 10) of throttle body 32 which intersects the main axis 64 of induction passage 34.

Figure 10:
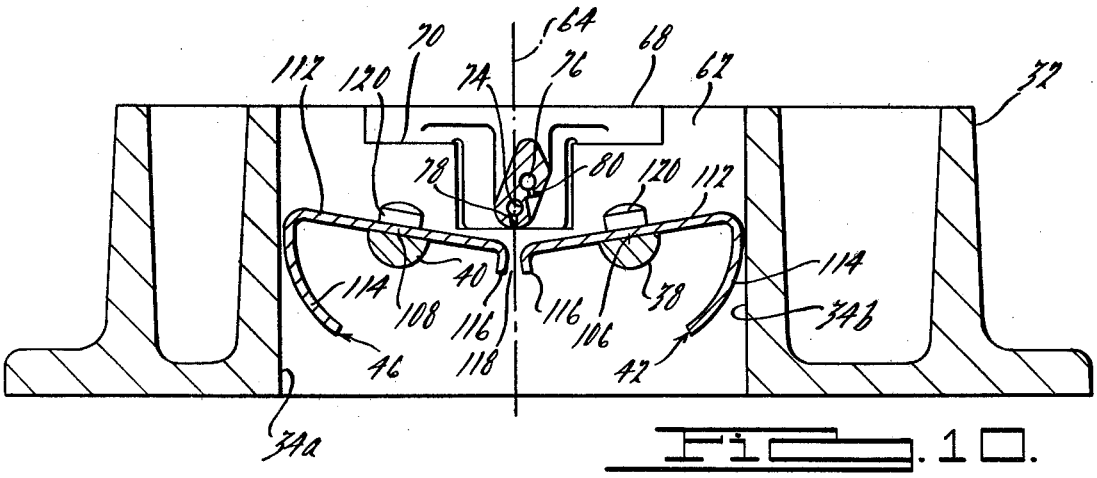
FIG. 10 is an enlarged sectional view taken along line 10—10 of FIG. 1.

Continuing in FIGS. 1 and 10, fuel distribution system 36, which comprises a pressure regulator assembly 66 and a spray bar 68, mounts directly on partition 62, with a T-shaped recess 70 being fashioned in the partition to receive spray bar 68. Pressure regulator assembly 66 is keyed with spray bar 68, and the former attaches to throttle body 32 by means of a pair of screws 72, spray bar 68 in turn being securely retained within recess 70 by virtue of its keyed engagement with assembly 66. Spray bar 68 extends in opposite directions from partition 62, and is disposed midway between the longer opposite walls 34*a*, 34*b* of the induction passage 34 but stops somewhat short of the shorter walls 34*c*, 34*d* of passage. A main (or light load) fuel distribution rail 74 and a power (or auxiliary) fuel distribution rail 76 extend lengthwise through spray bar 68. Spaced orifices 78 and 80 intercept rails 74 and 76 at selected intervals along the length of the spray bar and direct fuel downwardly into passage 34.

Figures 1, 7:
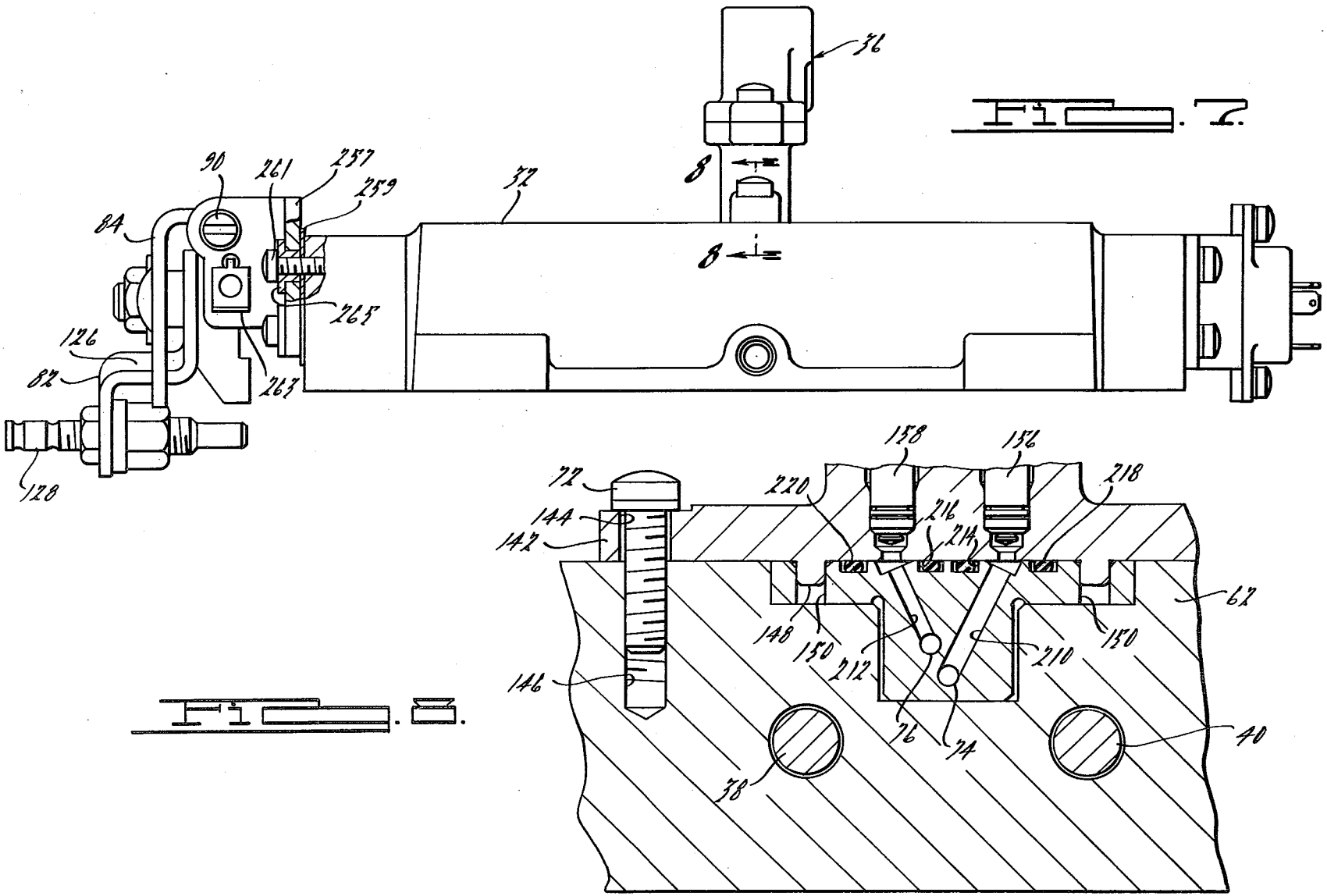
FIG. 7 is a view taken along line 7—7 in FIG. 1.
Figure 9:
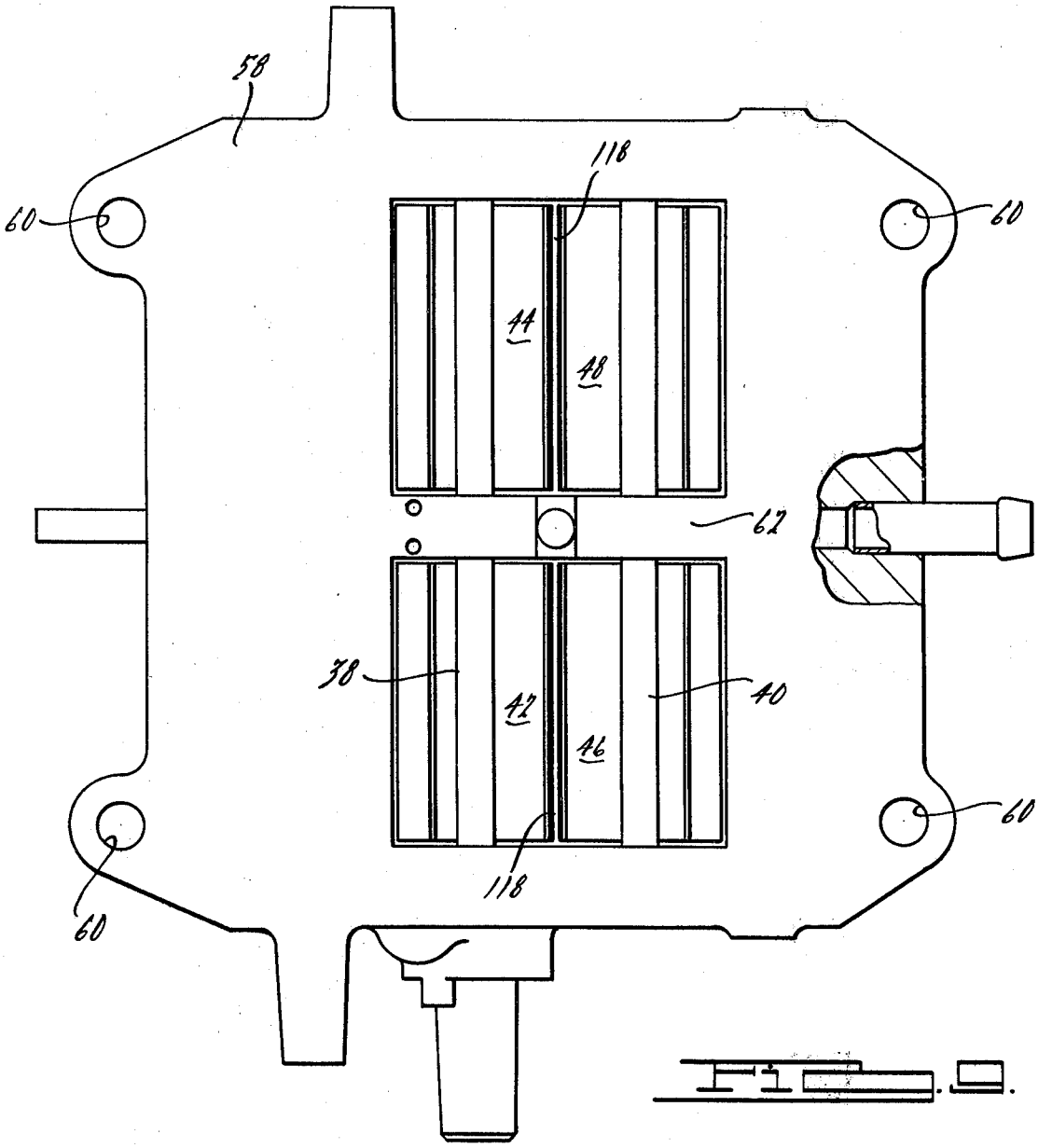
FIG. 9 is a bottom view of FIG. 1 with certain portions omitted for the sake of clarity.

The operator-controlled throttle actuating mechanism 54 (See FIGS. 1, 2, and 7) comprises a throttle arm 82, an idle arm 84, a sleeve 86, a helical spring 88, and an idle set screw 90. Briefly, the actuating mechanism attaches to shaft 38 so that as throttle arm 82 swings back and forth over an arc 92 the throttle blades open and close. As will be explained in greater detail later, the actuating mechanism includes a lost-motion connection which is utilized in conjunction with the constant engine idle speed control mechanism 56.

The constant engine idle speed control mechanism 56 comprises an electric motor 94, a speed reducer 96, a crank arm 98, a connecting link 100, a cam 102, and a cam follower 104. Briefly, this mechanism is operable to rotate crank arm 98 over an approximately 90° arc (between positions shown in FIGS. 3 and 4) to similarly rotate cam 102 over a comparable arc and thereby displace cam follower 104 over a small angular range of travel. Cam follower 104 is affixed to shaft 38 so that adjustment of the throttle blades at idle is accomplished whereby a constant engine idle speed is maintained.

Detailed Description of the Throttle Blade Operation

Shafts 38 and 40 extend across passage 34 between the opposite walls 34*c*, 34*d*. Shaft 38 is disposed approximately half way between axis 64 and wall 34*b*, while shaft 40 is located approximately half way between axis 64 and wall 34*a*, the two shafts being parallel to each other as well as to walls 34*a* and 34*b*. The two shafts are suitably journaled in throttle body 32 at walls 34*c* and 34*d* as well as at partition 62 (through which the two shafts pass) for rotation about their own axes 106, 108 (FIG. 10). As shown at the top of FIG. 1, the ends of shafts 38 and 40 extend beyond throttle body 32, and the two meshed sector gears 50 and 52 are affixed to shafts 38 and 40 respectively. The sector gears 50, 52 are so meshed as to couple shafts 38 and 40 for rotation in unison in opposite directions as viewed axially of the shafts. Blades 42, 44 are affixed to shaft 38, and blades 46, 48 to shaft 40 so that blades 42, 46 form one cooperating blade pair for one port and blades 44, 48 another for the other port. It will be observed that the blades are at least approximately balanced so that pressure differential across the blades cannot develop any significant rotational torque. This means that extra-ordinary torques are neither required to maintain the blades in the idle position to which they are typically biased via spring 88 and the usual accelerator linkage return spring 110 nor required to operate the blades over their operating range.

Each throttle blade comprises a main blade section 112, an auxiliary blade section 114, and a lip 116. In the illustrated preferred embodiment the blades are advantageously constructed from sheet metal stock which is formed into the desired shape and then precision ground in a manner to be hereinafter described. The main blade section 112 of each blade lies in a flat plane. The length of each blade is dimensioned to fit closely between the shorter walls 34*c*, 34*d* of passage 34 and partition 62, while the blade is such that when in idle position a restricted opening 118 is provided between the lips 116 of the cooperating blade pairs. In order to provide for attachment of the throttle blades to the throttle shafts, each throttle shaft has a pair of flats across a diameter thereof to each of which the main blade section of one of the blades is attached by means of screws 120. As will be apparent from FIG. 10, each restricted opening 118 increases in area as the throttle blades are increasingly displaced from idle position thereby reducing the restrictive effect. The auxilary blade section 114 of each blade serves an important function as the throttle blades are increasing displaced from idle position. As can be seen from consideration of FIG. 10, each auxiliary blade section 114 presents a curved confronting surface to the corresponding wall section 34*a*, 34*b*. The dimensions are such that as the blades are increasingly opened, a restrictive effect is maintained so that no appreciable amount of air is allowed to intrude between the auxiliary blade section and the corresponding wall section 34*a* and 34*b*. This is important in promoting the attainment of a more uniform and thorough combustible mixture since virtually all induction air is constrained to flow as a high velocity stream between the cooperating blade pairs where the fuel is discharged from spray bar 68.

In order to theoretically prevent any air from intruding between an auxiliary blade section and the confronting wall section of the induction passage, the surface of the auxiliary blade section confronting the induction passage wall section should lie on a circular arc concentric with the corresponding shaft axis and having a radius of curvature infinitesimally less than the minimum distance from the shaft axis to the wall section. From a practical manufacturing standpoint, the attainment of such precision is impossible. While the illustrated blade has the advantage of being formable from sheet or strip stock, dimensional control of the precise shape of the auxiliary blade section is difficult, particularly on a production basis. This is because the angle subtended by the auxiliary blade section must be large enough to accommodate the range of angular travel of the throttle shafts, and the larger the angle, the more difficult to control dimensionally the auxiliary blade curvature. However, this problem is solved by designing the auxiliary blade section to have a radius of curvature just slightly less than the minimum distance from the shaft axis to the induction passage wall section and preferably slightly offset from the shaft axis toward the induction passage wall section. Manufacture is accomplished by forming the blade to the desired shape and then precision grinding the auxiliary blade section to the specified contour. As the throttle shafts rotate from the idle position, interference between the auxiliary blade sections and the corresponding confronting induction passage wall sections is precluded; yet the amount of clearance is sufficiently small that at most only negligible intrusion of air therebetween occurs. Thus, virtually all induction air is confined between cooperating blade pairs to mix with fuel discharged from the spray bar. Lips 116 are helpful in promoting good flow characteristics between the opposed free edges of the main blade sections of each blade pair.

An especially accurate, and preferred, assembly of the blades to the shafts can be accomplished by providing attachment holes in the blades which are somewhat larger than the shanks of attaching screws 120 and located to provide for limited adjustment of the blades on the shaft. With the shafts in the position of maximum blade closure (such as shown in FIG. 10), the blades may be adjusted to provide edge contact of each auxiliary blade section with the corresponding wall section of the induction passage. Slight clearance at the ends of each blade to the throttle body is also provided. The screws 120 are then tightened to securely affix each blade in this position. Now when the shafts rotate, clearance is assured for the full range of throttle operation with an effective air seal being provided between the auxiliary blade sections and the corresponding confronting wall section of the induction passage. At and near wide open throttle, a small amount of air intrusion is tolerable. Tolerance is taken up between the lipped edges of each cooperating blade pair.

At idle, each blade is sealed with respect to the corresponding induction passage wall 34*a*, 34*b* by means of its auxiliary blade secton 114. Because the length of each blade must be slightly less than the length of the corresponding port (e.g., the dimension between partition 62 and wall 34*c* in the case of blades 44 and 48), there is a greater percentage of air leakage around the lengthwise ends of the blades at idle in comparison to the amount of air passing through the restricted opening 118 between cooperating blade pairs. While this leakage should not be a problem so long as the lengthwise clearance between each blade and port can be closely controlled (for example 0.001 or 0.002 inch or less), it is contemplated that sealing along the end edges of the main section of each blade can bring about an improvement (particularly at idle operation) whereby the openings 118 can be slightly enlarged to promote maximum velocity central airflow in the vicinity of spray bar 68. One way of incorporating such edge seals is to spray a Teflon coating of 0.002/0.003 inch thickness onto the end edges of the blades. Another possibility is the use of edge lip seals.

An example of a blade is made from 0.042" stock, has a length of about 2", and the main blade section has a width of about 1.2". The auxiliary blade section lies on an arc of about 75°. It is also desirable to apply a Teflon coating to each throttle shaft so that journal friction is minimized. Because it is more economical on a production basis to coat the entire shaft, the coating of the flats on which the blades seat provides a very low friction surface which may permit the throttle blades to shift on the shafts after screws 120 are tightened. Therefore, in order to preclude this possibility, a plurality of parallel scribe lines are made on the surface of main blade section 112 which is disposed against the shaft flat. The scribe lines will raise edges along the surface of the blade which penetrate the shaft coating to embed in the shaft itself as the screws 120 are tightened thereby more securely holding the blade in the correct position on the shaft. The blade areas on each side of the shaft are not quite equal. Slightly larger area has been designed on the auxiliary blade side such that the blade itself tends to be self-closing on the shaft due to vacuum forces.

The illustrated embodiment of throttle body assembly 30 is particularly suited for use with a V-8 engine whereby one bank of cylinders is essentially fed via one port of the assembly and the other bank, via the other port. Hence, with other engine configurations, other embodiments of the invention would normally be utilized. For one example, a throttle body for four cylinder engine might use only one set of cooperating blade pairs in a single port.

Detailed Description of Throttle Actuating Mechanism 54

Actuating mechanism 54 serves to rotate shafts 38 and 40 (and hence the four throttle blades, 42, 44, 46, and 48) in response to operation of the usual accelerator linkage 122 (FIG. 2) provided in a vehicle. As shown at the bottom of FIG. 1, shaft 38 extends beyond throttle body 32 a distance sufficient to receive actuating mechanism 54. Sleeve 86 is disposed over shaft 38 to support spring 88 thereon. Idle arm 84 is affixed to shaft 38 for rotation therewith. Throttle arm 82 is free to rotate on shaft 38; however, the two arms, 82 and 84, are designed to provide a small angular lost-motion connection. This lost-motion connection is provided by means of a bight 124 fashioned in idle arm 84; throttle arm 82 is provided with a segment 126 which fits within bight 124 and is dimensioned to a width somewhat less than that of the bight. A pin 128 on throttle arm 84 connects with accelerator linkage 122 whereby throttle arm 84, in response to operation of the accelerator pedal by the vehicle operator, may be operated over an angular range indicated by the arrow 92 in FIG. 2. Spring 88 is torsionally interengaged between throttle body 32 and a tab 130 on idle arm 84 whereby arm 84 is biased in the clockwise direction as viewed in FIG. 2. In turn, a tab 132 on throttle arm 82 is biased into engagement with idle adjustment screw 90 on throttle body 32 by virtue of the lost-motion connection between the two arms 82 and 84. FIG. 2, therefore, illustrates the assembly in the idle position with maximum blade closure for a given setting of screw 90. The lost-motion connection between arms 82 and 84 provides a small lost-motion connection between accelerator linkage 122 and the throttle blades and is provided for cooperation with the engine constant idle speed control. Displacement of throttle arm 82 from the position shown in FIG. 2 along the arc 92 rotates shafts 38 and 40 in unison in opposite directions to in turn rotate the four throttle blades.

Detailed Description of Fuel Distribution System 36

Figure 11:
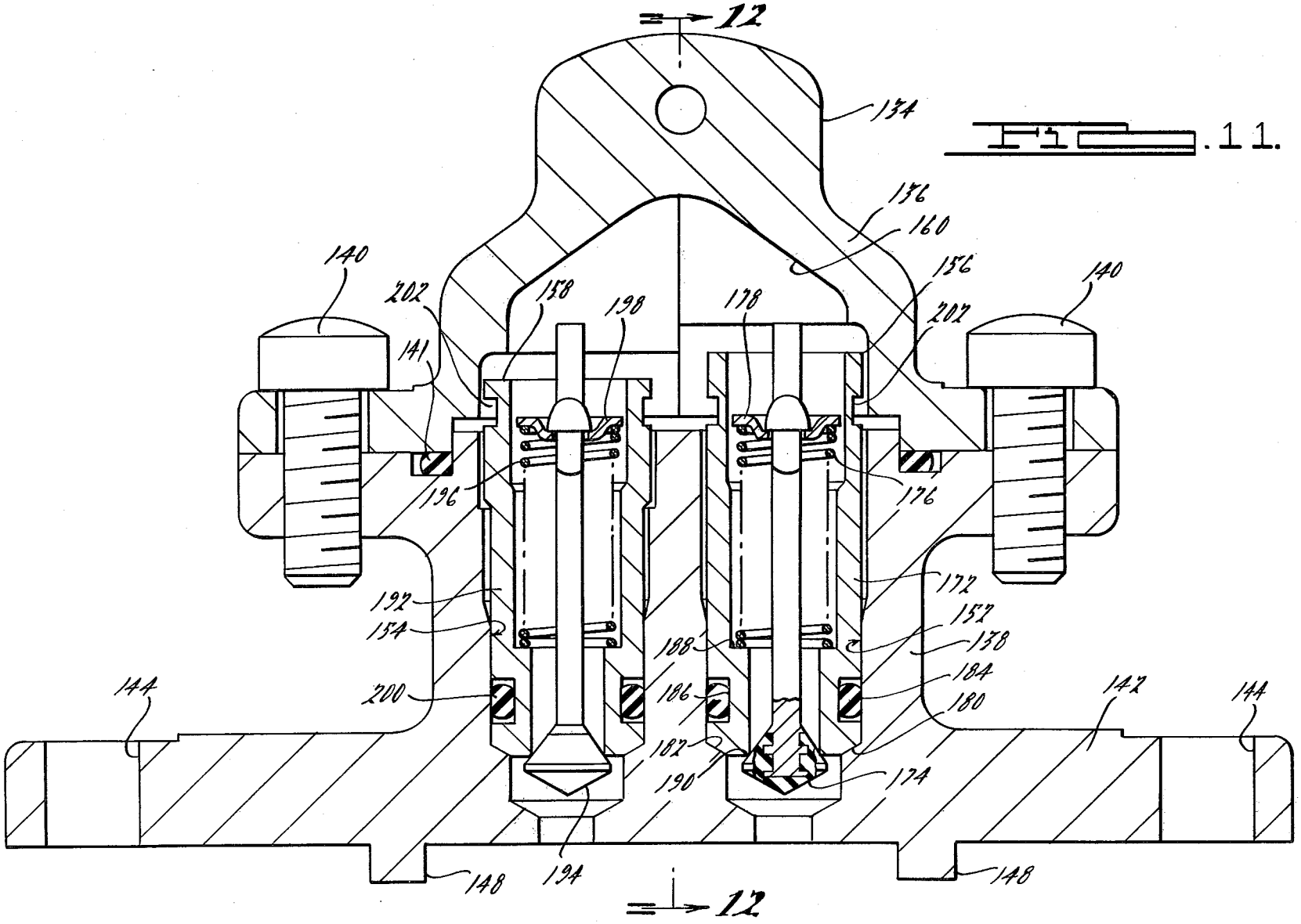
FIG. 11 is an enlarged sectional view taken along line 11—11 in FIG. 1 and having portions omitted for the sake of clarity.
Figure 12:
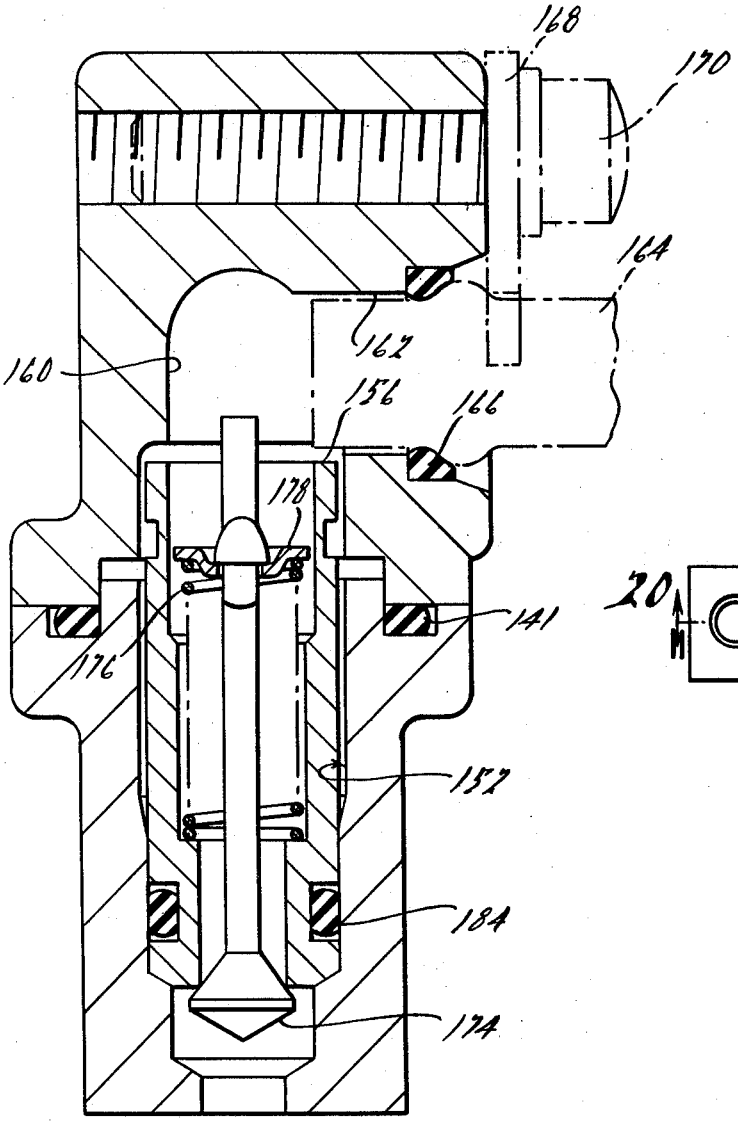
FIG. 12 is a sectional view taken along line 12—12 in FIG. 11.
Figure 13:
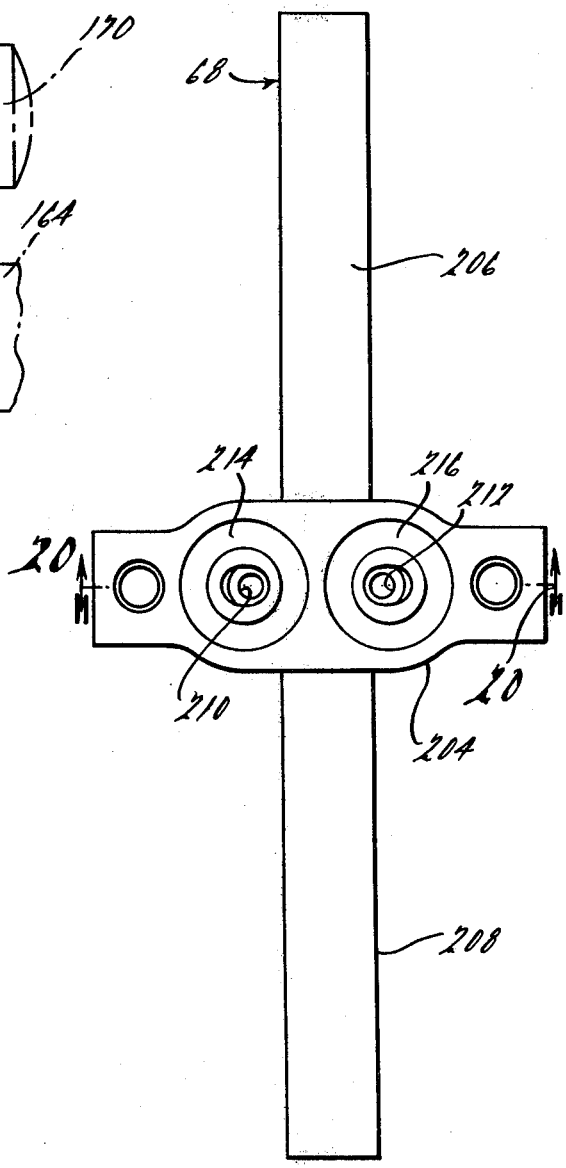
FIG. 13 is a plan view of one of the elements of the assembly shown by itself.

Pressure regulator assembly 66 is shown in detail in FIGS. 11 and 12 and comprises a housing 134 defined by upper and lower housing elements 136, 138, respectively, which are secured together by means of fasteners 140 and sealed by a seal 141. Lower housing element 138 has a horizontal base 142 which supports the regulator assembly on partition 62 (see FIG. 8). A pair of holes 144 are provided at opposite ends of base 142 with screws 72 passing through holes 144 and into holes 146 to securely mount the regulator assembly on the throttle body. A pair of circular dowel pins 148 depend from base 142 into keyed engagement with a pair of corresponding holes 150 (FIG. 8) in spray bar 68 so as to hold the latter in recess 70. A pair of vertical, circular, cylindrical throughbores 152 and 154 respectively, each having several shoulders therein, are provided in lower housing element 138. A main (or light load) pressure relief valve assembly 156 is disposed in bore 152 and an auxiliary (or power) pressure relief valve assembly 158 in bore 154. Upper housing element 136 is shaped to provide a headspace 160 above the upper ends of the two pressure relief valve assemblies 156, 158. As shown in FIG. 12, a horizontal inlet bore 162 intercepts headspace 160 and is adapted to receive a fuel inlet conduit 164. Conduit 164 is sealed with respect to bore 162 by means of an O-ring seal 166 and is held in place by means of a retainer 168 which is fastened to upper housing element 136 by means of a screw 170. In operation, liquid fuel is supplied via conduit 164 to the pressure regulator assembly.

The two pressure relief valve assemblies 156, 158 are very similar to each other, and therefore only valve assembly 156 will be described in detail. Valve assembly 156 comprises a tubular valve body 172 open at both upper and lower ends, a movable valve member 174, a helical spring 176, and a retainer 178. Assembly of valve assembly 156 into housing 134 in accomplished by inserting the valve asembly into the open upper end of bore 152 prior to assembling the two housing elements together. The valve assembly is inserted into bore 152 until a chamfer 180 at the lower end of valve body 172 abuts a shoulder 182 of bore 152. A compressible, resilient O-ring seal 184 is lodged in a groove 186 extending around the outside of valve body 172 to seal between the outside of the valve body and the wall of the bore. Spring 176 is disposed around the outside of the stem of valve member 174 and is disposed between a shoulder 188 on the inside wall of the valve body and retainer 178 whereby valve member 174 is biased upwardly as viewed in FIGS. 11, 12 so as to seat the head of valve member 174 on a circular seat 190 at the lower end of valve body 172. Valve member 174 is self-centering. Liquid fuel introduced via conduit 164 into the pressure regulator assembly will flow downwardly to fill the passage through the valve body so that liquid fuel pressure will act upon the head of valve member 174 in a direction tending to displace the same downwardly against the upward force exerted by spring 176. The amount of pressure required to unseat valve member 174 is a function of the area on which the fluid pressure acts and the preload and rate characteristics of spring 1976. When sufficient pressure is developed to unseat valve element 174 from seat 190, liquid fuel is discharged from the pressure regulator assembly via the lower end of bore 152.

Valve assembly 158 comprises a valve body 192, a valve member 194, a helical spring 196, and a retainer 198. An O-ring seal 200 lodges in a groove around the outside of valve body 192 to seal between the valve assembly and the wall of bore 154. Liquid fuel which is introduced into housing 134 also flows to fill the passage through valve body 192 and when a certain pressure is reached, valve member 194 unseats from valve body 192, so that liquid fuel is discharged at the lower end of bore 154. For reasons which will be explained in greater detail hereinafter, the pressure at which valve member 194 unseats from valve body 192 is greater than the pressure at which valve member 174 unseats from valve body 172.

Figure 15:
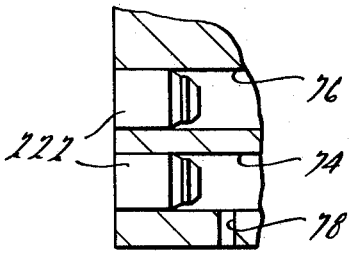
FIG. 15 is an enlarged sectional view taken along line 15—15 in FIG. 14.
Figure 14:
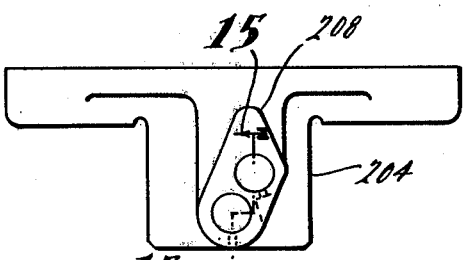
FIG. 14 is a front view of FIG. 13.
Figure 16:
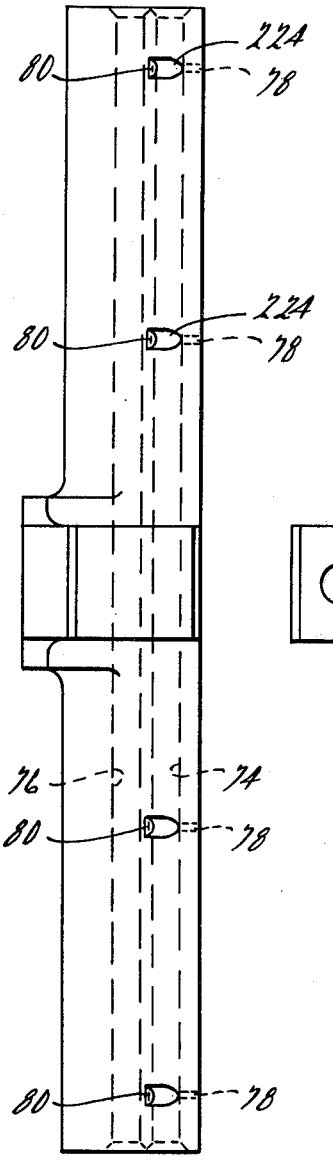
FIG. 16 is a right side view of FIG. 13.
Figure 17:
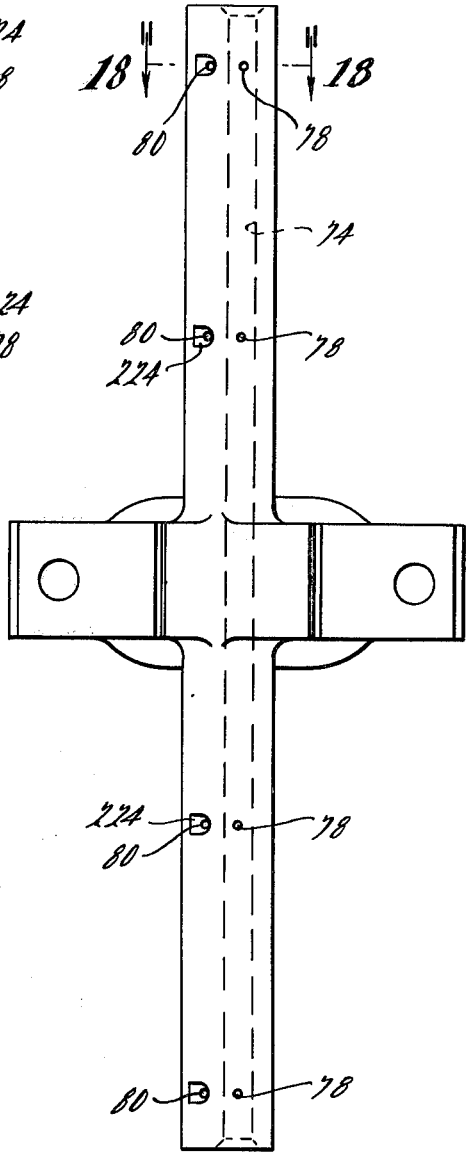
FIG. 17 is a bottom view of FIG. 13.
Figure 18:
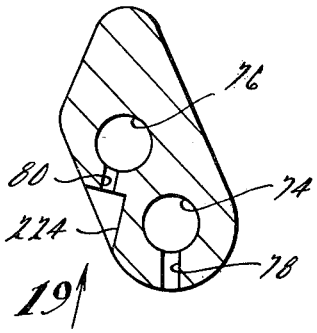
FIG. 18 is an enlarged sectional view taken along line 18—18 in FIG. 17.
Figure 19:
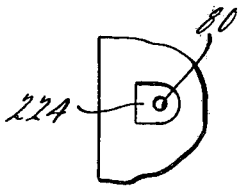
FIG. 19 is a fragmentary view taken in the direction of arrow 19 in FIG. 18.
Figure 20:
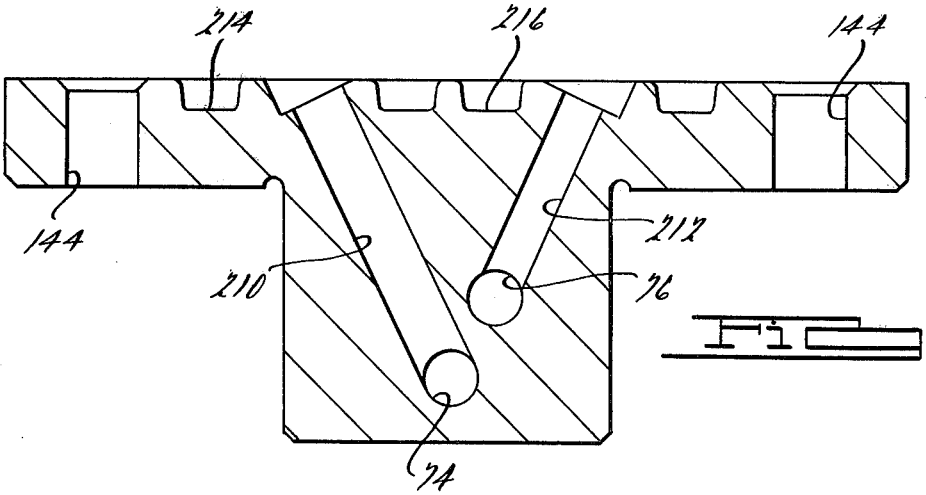
FIG. 20 is an enlarged sectional view taken along line 20—20 in FIG. 13.
Figure 21:
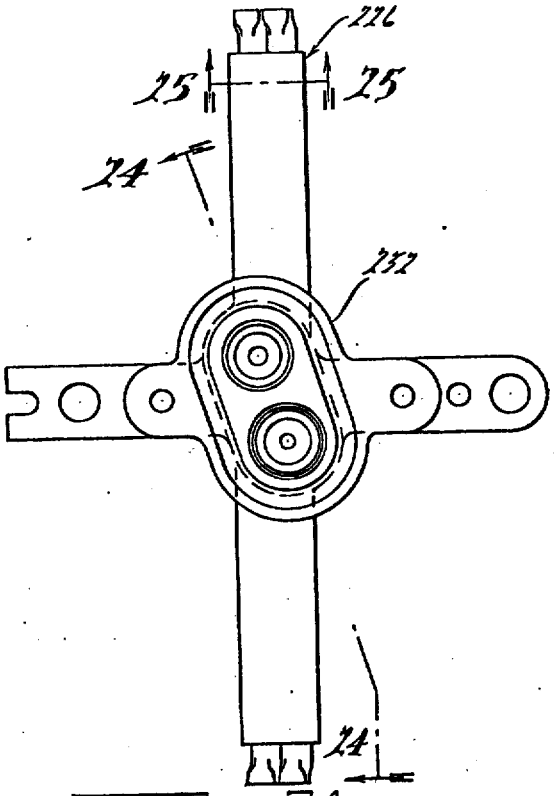
FIG. 21 is a plan view of an alternate embodiment of the element shown in FIGS. 13–20.
Figure 22:
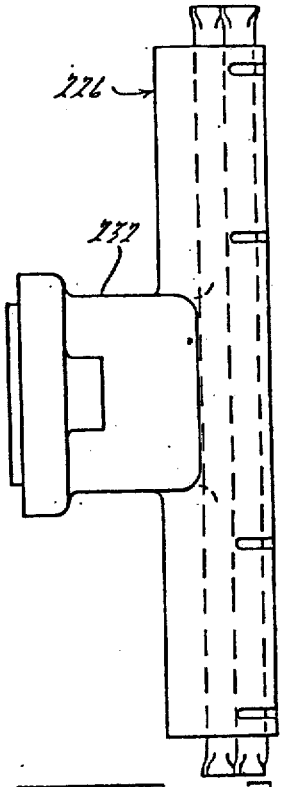
FIG. 22 is a right side view of FIG. 21.
Figure 23:
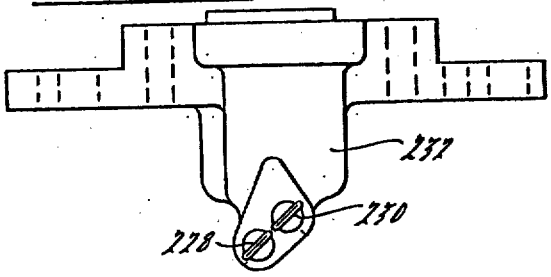
FIG. 23 is a front view of FIG. 21.
Figure 24:
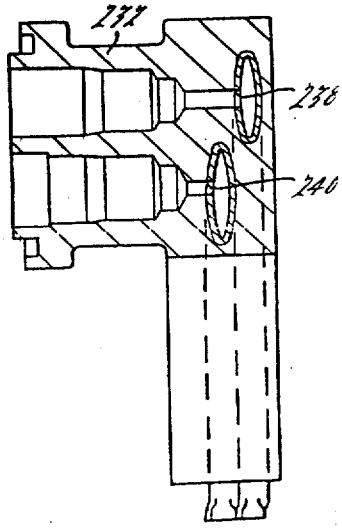
FIG. 24 is a view partly in section taken along line 24—24 in FIG. 21.
Figure 25:
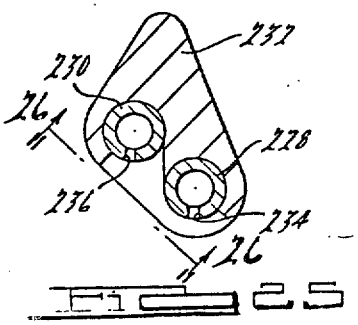
FIG. 25 is an enlarged sectional view taken along line 25—25 in FIG. 21.
Figure 26:
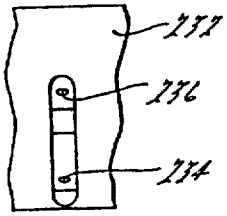
FIG. 26 is a fragmentary view taken along line 26—26 in FIG. 25.

Attention is now directed to details of spray bar 68 shown in FIGS. 13–20. The spray bar comprises a central body 204 having a T-shaped transverse cross section as shown in FIG. 14. Extending lengthwise of the spray bar from opposite sides of central body 204, are rail sections 206, 208. The main fuel rail 74 is formed as a straight, circular, cylindrical passage extending the full length of the spray bar through rail sections 206, 208, and central body 204. The auxiliary fuel distribution rail 76 is also formed as a straight, circular, cylindrical passage extending the full length of the spray bar and parallel to, but spaced from, rail 74. Within central body 204, a bore 210 extends from the upper surface of body 204 downwardly at an angle to intercept rail 74, and a passage 212 extends from the upper surface of body 204 at an angle to intercept rail 76. When the spray bar and the pressure regulator assembly are in assembled relationship (FIG. 8), bore 210 is in communication with the outlet of bore 152 and bore 212 is in communication with the outlet 154. Circular grooves 214, 216 respectively are provided around bores 210, 212 respectively in the upper surface of the spray bar central body, and O-ring seals 218, 220 (FIG. 8) are lodged in these grooves to seal between the pressure regulator housing and the spray bar around the two bores 210, 212 respectively at their respective points of communication with bores 152 and 154 respectively. As shown in FIG. 15, the ends of each of the two rails 74, 76 are closed by suitable plugs 222. The plurality of small circular discharge orifices 78 are formed in the spray bar to intercept main rail 74, and the plurality of discharge orifices 80 intercept auxiliary rail 76. The illustrated spray bar utilizes four discharge orifices 78, and four discharge orifices 80, two each on each side of the spray bar. Discharge orifices 78 are directed vertically downwardly from rail 74, and discharge orifices 80 are also directed downwardly from rail 76, but at a slight angle to the vertical. The directions may be determined empirically to obtain optimum engine performance and therefore the illustrated example represents one possible configuration which has been found to perform excellently on a V-8 engine. A recess 224 is provided for each of the discharge orifices 80 to present a flat surface into which the drill which forms the orifices can bite without skidding on the otherwise sharply angled surface of the spray bar rail section. The spray bar may be constructed as an aluminum die casting which is suitably machined to form the finished part. The fuel rails may be formed by means of conventional techniques, such as by gun drilling. The other passages and orifices may be formed using conventional techniques.

FIGS. 21–26 illustrate an alternate spray bar embodiment 226 which offers certain advantages over spray bar 68. This alternate embodiment 226 comprises a pair of drawn stainless steel tubes 228, 230 which form the main and auxiliary fuel rails respectively. The spray bar body 232 is cast around tubes 228, 230 using conventional insert casting techniques. For example, zinc die cast or a suitable plastic may be used. The body is shaped to accommodate bores 152 and 154 into which the pressure relief valve assemblies 156 and 158 are inserted so that embodiment 226 incorporates the lower housing element 138 of the first embodiment as an integral part thereof. The separate O-ring seals 218, 220 are thus eliminated. Tubes 228, 230 are closed off by flattening and sealing the ends thereof to the illustrated shapes. Suitable discharge orifices 234, 236 are provided in tubes 228, 230 and the tubes are in communication with the pressure regulator valves by providing suitable inlets 238, 240 in the side walls thereof. The other reference numerals shown in FIGS. 21–26 identify the same items as in the first embodiment. This embodiment readily lends itself to the formation of the discharge orifices by means of electrical discharge machining (EDM) or by means of laser beam drilling, or by some other suitable drilling procedure. Such techniques permit precise diameters of the discharge orifices to be maintained on an economical production basis. It should be mentioned that the recess in partition 62 of the illustrated throttle body should be suitably shaped to receive the spray bar body which in this instance has a different cross-sectional shape from that of the previous embodiment. This alternate embodiment can offer manufacturing and cost advantages.

A throttle body embodying principles of the present invention is particularly suited for use in an electronic fuel metering system wherein a fuel control pump is driven by an electric motor which is controllably energized from an electronic control system to cause a controlled amount of fuel to be metered via the fuel distribution system for mixture with the high velocity induction air stream, the air flow being measured by a suitable air flow measuring device and the control system controlling the fuel/air ratio. By way of example, a system which could utilize the fuel distribution system disclosed herein is illustrated in U.S. Pat. No. 3,935,851, assigned to the same assignee as the present application. In such a use the motor-driven fuel pump delivers gasoline through a fuel flow measuring transducer and thence via conduit 164 to pressure regulator assembly 66. By making the rate of spring 176 less than that of spring 96, main valve 156 opens at a lower pressure than auxiliary valve 158. By way of example, the valves may be designed so that valve 156 opens within a pressure range of 13 to 17 PSIA and valve 158 opens within a range of 24 to 31 PSIA. While it is advantageous to have the valve member self-centering on the valve seat, it has been found that oscillations of the valve member can occur if careful attention is not directed to the relative proportions of the valve head. It has been discovered that oscillations of the valve can be avoided by making the aspect ratio (i.e. the ratio of the diameter of the seat to the diameter of the head) 0.83 or greater. Valve oscillation is undesirable in that first it introduces hydraulic pressure fluctuations which are transmitted upstream to the fuel flow transducer thereby introducing undesired inaccuracies and second, because pressure fluctuations are created in a spray bar. In the illustrated example, the dimension across the valve head is approximately 0.190 inch. A preferred construction for the valve member is to mold a viton rubber head onto one end of a metal stem as shown in a fragmentary section in FIG. 11. Excellent valve life and sealing characteristics are provided with this construction. By way of example, the edge of the valve seat 190 may have a 0.015 inch radius.

One important advantage of the illustrated two-stage regulator is that the typical fuel consumption rate of a typical engine can be accommodated without an extremely high pressure system. In the example of the illustrated embodiment, by designing valve 156 to open at 15 PSI pressure it fulfills fuel demands of up to 60 pounds per hour. When the demand exceeds 60 pounds per hour, power valve 158 also opens (corresponding to pressures of 27½ PSIA nominal), and both valves can fulfill demand of up to 150 pounds per hour which represents a typical peak fuel consumption loading. At the maximum rate of 150 pounds per hour, the maximum system pressure is on the order of 50–60 PSI. This avoids a much higher pressure system wherein pressures on the order of 150 PSIA would be typical. Accordingly, more stringent hardward requirements which are necessary in a higher pressure system are avoided in the present system.

In order for the spray bar to discharge fuel as distinct spray jets, it is important to appropriately size the discharge orifices. This spraying is beneficial in promoting more thorough mixture of fuel with induction air. The ratio of the diameter of each discharge orifice to its corresponding rail should be such that the flow rate of fuel has little effect on the amount of fuel sprayed from each orifice. Stated another way, the sizing and the number of orifices for each rail, and the rail size, are preferably such that the characteristic of fuel pressure in the rail vs. fuel discharge rate from the rail is determined essentially solely by the orifices.

Another feature of the disclosure is that the spray bar is disposed upstream of the throttle blades so that the discharge orifices are always exposed to atmospheric, or nearly atmospheric, pressure. In the illustrated example, both rails have a diameter of 0.094 inches while discharge orifices 78 have a diameter of 0.020 inches, and orifices 80 have a diameter of 0.024 inches. The length of each discharge orifice should be sufficiently short to insure that it acts like an orifice rather than like a pipe. In the example, the use of four such discharge orifices for each fuel rail is sufficient to supply a 250 cu. inch or larger engine for use in an automobile or truck. Although the present embodiment is merely exemplary, it is believed undesirable to make the diameters of the discharge orifices smaller since there would be greater tendency for them to clog with any foreign particles that may be present in the fuel. It is believed that the disclosed size of the orifices is sufficient to preclude the necessity of an in-line fine fuel filter in the fuel metering system. By providing a pressurized fuel distribution system, fuel is kept under pressure to a point just before being discharged into the relatively cool fuel bar which is cooled by the induction air flow. This reduces the chance for vapor formation during very hot operation. The regulator also maintains pressure in the system during engine shutdown, and this is helpful in preventing excessive vapor formation and discharge into atmosphere when a hot engine is shut off. The regulator is also helpful in maintaining fuel in the spray bar when the engine is off. Where an in-tank fuel pump is employed to pump fuel to the control pump, leakage past the control pump and into the induction passage is avoided by setting the opening pressures for the regulator valves higher than the maximum pressure output of the in-tank pump.

Because of the small dimensions involved, it is desirable to check the fuel bar for burrs, metals particles, and other foreign material which could obstruct or interfere with the intended fuel distribution. The use of appropriate reamers and thorough cleaning is, therefore, highly desirable. Checking of all aluminum die castings for leakage is also important, and where such leakage is a problem, vacuum impregnation techniques can be used to correct it.

The cooperative performance of the illustrated fuel distribution and throttle blade constructions promotes homogeneous mixture formation over the range of throttle positions for all operative engine modes and represents a significant improvement in the art.

Detailed Description of Constant Engine Idle Speed Control Mechanism 56

Figures 4, 5, 6:
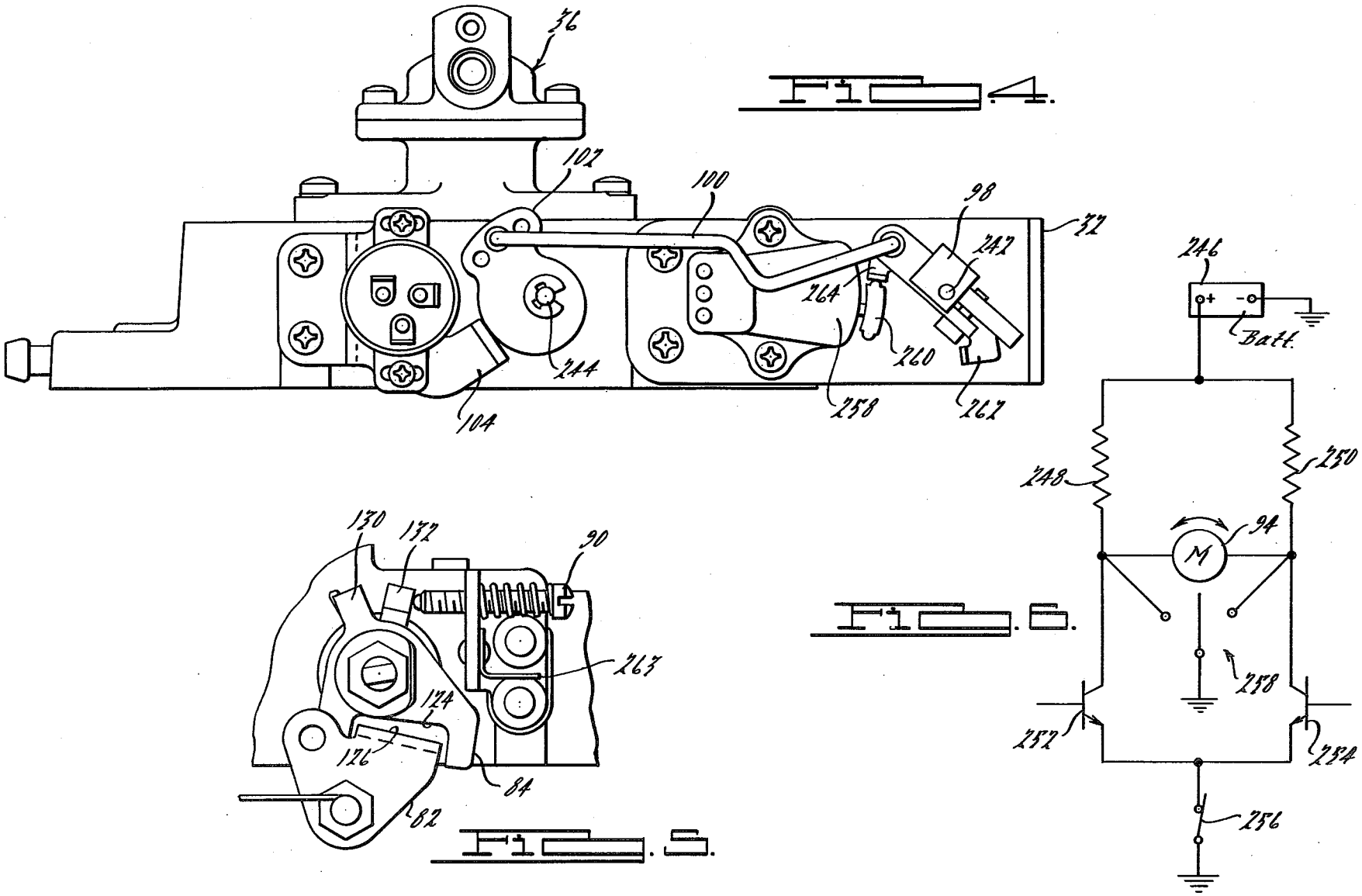
FIG. 4 is a view similar to FIG. 3 showing a different operative position.
FIG. 5 is a fragmentary view showing a portion of FIG. 2 in the same operative position of the assembly as that shown in FIG. 4.
FIG. 6 is an electrical schematic diagram of electrical controls utilized with the illustrated throttle body assembly.

Motor 94 is a small bi-directional DC type whose output shaft is coupled to the input shaft of speed reducer 96. Crank arm 98 is secured to the output shaft 242 of speed reducer 96. Motor 94 is operated via the control circuit shown in FIG. 6 (hereinafter explained) such that when the motor rotates in one direction, crank arm 98 swings in the counter-clockwise sense as viewed in FIGS. 3 and 4, and when the motor rotates in the opposite direction, the crank arm swings in the clockwise sense. Link 100 has its right hand end, as viewed in FIGS. 3 and 4, attached to the radially outer end of crank arm 98 and its left hand end attaches to cam 102. Cam 102 is disposed on a shaft 244 on the throttle body such that it may be displaced over an angular range corresponding to the angular range over which crank arm 98 is operative. Follower 104 is affixed to throttle shaft 38. Because spring 88 of the actuating mechanism biases idle arm 84 in the clockwise direction as viewed in FIG. 2, follower 104 is biased in the counter-clockwise direction as viewed in FIGS. 3 and 4 whereby the follower is biased into engagement with cam 102. Therefore, it will be appreciated that as cam 102 rotates from the position shown in FIG. 3 to the position shown in FIG. 4, shaft 38 rotates over a small angular range to thereby slightly increase the area of opening 118 between the throttle blade pairs. As this occurs, the lost-motion connection between the idle and throttle arms 82 and 84 permits the idle arm to rotate in the counter-clockwise direction (as viewed in FIG. 2) relative to the throttle arm so that the resulting adjustment of the throttle blades by operation of the engine constant idle speed mechanism is not fed back to the accelerator control linkage to the accelerator pedal inside the vehicle. FIG. 2 illustrates the relative positions of the idle and throttle arms with the throttle body assembly in idle position wherein the area of opening 118 is at a minimum. The idle position is defined by abutment of tab 132 with screw 90. FIG. 5 illustrates the relative positions with the assembly in the idle position wherein the area of opening 118 is a maximum. Thus at idle, the size of opening 118 will be automatically adjusted to an appropriate setting within this range whereby constant engine idle speed is maintained.

FIG. 6 illustrates an electrical schematic diagram of a control circuit for operating motor 94. The circuit is operatively coupled with the existing vehicle battery 246 and includes a pair of resistors 248, 250, and a pair of NPN type transistors 252, 254. An idle position sensing switch 256 and an overtravel safety switch 258 are also associated with the circuit. When it is desired to operate motor 94 in such a manner that the throttle blades are increasingly opened, transistor 252 conducts so that current flows from the positive terminal of the battery, through resistor 250, through motor 94, through the collector-emitter circuit of transistor 252 and through switch 256 back to the ground terminal of the battery. Transistor 254 does not conduct. When it is desired to operate motor 94 so that the throttle blades are operated toward a more restrictive position, then transistor 254 conducts and transistor 252 does not so that current now flows from the positive terminal of battery 246, through resistor 248, through motor 94, through the collector-emitter of transistor 254, and through idle switch 256 back to the ground terminal of the battery. Thus, adjustment of the throttle blades by the constant idle speed adjustment mechanism occurs only when the assembly is in the idle position. Sensing of the idle position is accomplished by utilizing the idle adjustment screw 90 as one contact of switch 256 and using tab 132 on throttle arm 82 as the other contact of the switch. As can be seen in FIGS. 1 and 2, idle adjustment screw 90 is threaded into a right angle bracket 257 which mounts on the throttle body by means of two attaching screws 261. Bracket 257 is electrically insulated from the throttle body by an insulator spacer 259 and insulator bushings 265. An electrical terminal 263 is riveted to the right angle bracket to provide for connection of a mating electrical terminal (not shown) leading from the common emitters of transistors 252, 254. Throttle arm 82 is grounded so that whenever throttle arm 82 contacts screw 90, a ground is provided at terminal 263 to provide a ground for energizing motor 94.

Safety switch 258 mounts on the side of the throttle body adjacent crank arm 98. The switch has a self-centering actuator 260 which is disposed for engagement by tabs 262 and 264 on crank arm 98. FIG. 3 illustrates the tab 262 displacing the switch actuator upwardly from its center position while FIG. 4 illustrates tab 264 displacing the switch actuator downwardly from its center position. Basically, the switch is intended to shut down the motor when an overtravel condition occurs so as to preclude the possibility of motor damage due to an overload. In the design of the mechanism, it is contemplated that tripping of the switch will not occur over the normal operative range.

For the purpose of sensing the throttle position there are provided two sensing devices. One is a potentiometer 266 which is directly coupled to shaft 38 and the other is a variable inductance transducer 268 which mounts on the opposite side of the assembly and is actuated via a lever arm which is attached to shaft 40. These two devices may be utilized in conjunction with fuel metering and spark advance systems which utilize throttle position information as inputs thereto.

One advantage of the constant idle speed control is that a substantially constant engine idle speed can be maintained which is independent of engine load and temperature. One basic idle has been set by adjustment of screw 90 for a given engine loading and temperature, the constant engine idle control can adjust the throttle blade position at idle so that the correct amount of mixture is inducted to maintain the desired engine idle speed. In a conventional engine lacking a constant idle speed control, the basic idle must be set high enough so that as the engine is lugged down by use of engine driven accessories (i.e. compressors, pumps, etc.) it will not stall. Thus in the conventional engine fuel is necessarily wasted when the accessories are not being used. The invention, in summary, provides useful improvement in a throttle body assembly.

What is claimed is:

1. In a throttle body assembly comprising a throttle body defining an induction passage, throttle shaft structure rotatably mounted on said throttle body, throttle blade structure disposed in said induction passage and operable by selective rotation of said throttle shaft structure to selectively throttle said induction passage, actuating means for rotating said throttle shaft structure and operating said throttle blade structure from a preset basic idle position over a range of positions, said actuating means including a first element affixed to said throttle shaft structure, a second element, and a lost motion connection coupling said first and said second elements which permits rotation of said throttle shaft structure within a limited initial increment of said range without imparting motion to said second element, means for both establishing the preset basic idle position and sensing when said second element is in a position which will allow said throttle blade structure to occupy the preset basic idle position comprising an adjustment element disposed on said throttle body for abutment by said second element, means biasing said second element toward abutment with said adjustment element, said actuating means further including means for moving said second element against the bias of said biasing means to selectively rotate said throttle shaft structure and operate said throttle blade structure over said range, an electrically actuated prime mover, a rotary output shaft driven by said prime mover, a crank arm affixed to said output shaft, means operatively coupling said throttle shaft structure and said crank arm for causing said throttle shaft structure to rotate when said output shaft is driven by said prime mover, and an electric circuit for operating said prime mover including a circuit connection which senses when said second element is in abutment with said adjustment element to permit operation of said prime mover only when such abutment occurs.

2. In a throttle body assembly as set forth in claim 1, said adjustment element comprising an adjustment screw.

3. In a throttle body assembly as set forth in claim 1, said second element being disposed for rotation about the same axis as said first element.

* * * * *

UNITED STATES PATENT AND TRADEMARK OFFICE

CERTIFICATE OF CORRECTION

PATENT NO. : 4,161,928

DATED : July 24, 1979

INVENTOR(S) : Kenneth W. Teague and Kenneth A. Graham

It is certified that error appears in the above-identified patent and that said Letters Patent are hereby corrected as shown below:

In the drawings, insert sheet 9 of 9 which consists of Figs. 21,22,23,24, 25 and 26.

In the drawings, sheet 1, line 1, after "Sheet 1 of" change "8" to --9--.
In the drawings, sheet 2, line 1, after "Sheet 2 of" change "8" to --9--.
In the drawings, sheet 3, line 1 after "Sheet 3 of" change "8" to --9--.
In the drawings, sheet 4, line 1, after "Sheet 4 of" change "8" to --9--.
In the drawings, sheet 5, line 1, after "Sheet 5 of" change "8" to --9--.
In the drawings, sheet 6, line 1, after "Sheet 6 of" change "8" to --9--.
In the drawings, sheet 7, line 1, after "Sheet 7 of" change "8" to --9--.
In the drawings, sheet 8, line 1, after "Sheet 8 of" change "8" to --9--.

Signed and Sealed this

*Twenty-third* Day of *August 1983*

[SEAL]

*Attest:*

*Attesting Officer*

GERALD J. MOSSINGHOFF

*Commissioner of Patents and Trademarks*